US005473832A

United States Patent [19]

Briechle et al.

[11] Patent Number: 5,473,832

[45] Date of Patent: Dec. 12, 1995

[54] NON-SLIDABLE DISPLAY LABEL

[75] Inventors: George T. Briechle, New Canaan, Conn.; Marvin Ackerman, Sunnyvale, Calif.

[73] Assignee: Electronic Retailing Information Systems Int'l Inc., Wilton, Conn.

[21] Appl. No.: 965,877

[22] Filed: Oct. 23, 1992

[51] Int. Cl.[6] ..... G09F 3/18

[52] U.S. Cl. ..... 40/642; 40/651

[58] Field of Search ..... 40/642, 651, 653, 40/662, 299, 1.6; 248/221.2, 222.3, 225.1; 403/294, 325, 326

[56] References Cited

U.S. PATENT DOCUMENTS

| | | | |
|---|---|---|---|
| 1,973,413 | 9/1934 | McDonnell | 40/651 |
| 2,822,631 | 2/1958 | Lynch . | |
| 2,859,546 | 11/1958 | Gutterson | 40/642 |
| 4,002,886 | 1/1977 | Sundelin . | |
| 4,179,138 | 12/1979 | Bogdanovic | 40/651 X |
| 4,330,952 | 5/1982 | Swanson | 40/642 X |
| 4,346,453 | 8/1982 | Drapeau et al. . | |
| 4,500,880 | 2/1985 | Gomersall et al. . | |
| 4,766,295 | 8/1988 | Davis et al. . | |
| 4,783,740 | 11/1988 | Ishizawa et al. . | |
| 4,821,291 | 4/1989 | Stevens et al. . | |
| 4,888,709 | 12/1989 | Revesz et al. . | |
| 4,939,861 | 7/1990 | Soublière | 40/651 |
| 4,957,255 | 9/1990 | John | 248/222.3 |
| 5,019,811 | 5/1991 | Olsson et al. . | |
| 5,080,521 | 1/1992 | Quaile | 403/326 |
| 5,111,196 | 5/1992 | Hunt . | |
| 5,172,314 | 12/1992 | Poland et al. . | |
| 5,198,644 | 3/1993 | Pfieffer et al. . | |
| 5,241,467 | 8/1993 | Failing et al. . | |
| 5,245,534 | 9/1993 | Waterhouse et al. . | |

FOREIGN PATENT DOCUMENTS

| | | |
|---|---|---|
| 299355 | 1/1989 | European Pat. Off. . |
| 0396414 | 3/1990 | European Pat. Off. . |
| 2197564 | 5/1988 | United Kingdom . |
| 2228812 | 5/1990 | United Kingdom . |
| 9305475 | 3/1993 | WIPO . |
| 9305456 | 3/1993 | WIPO . |

*Primary Examiner*—Kenneth J. Dorner
*Assistant Examiner*—J. Silbermann
*Attorney, Agent, or Firm*—Oppedahl & Larson

[57] ABSTRACT

An electronic price displaying label is disclosed for use in conjunction with a rail, the rail having two lips which define an access slot and a cavity, in which the label is prevented from slidably moving in a horizontal direction along the rail. The label has a protuberance connected to the rear of the label and first and second grooves arranged on the rear of the label such that the label can be secured in a display position along the rail. The aforementioned grooves disposed on the rear of the label contain a resilient substance such as a rubber band. The protuberance of the label may be removed from and inserted into the cavity of the rail when the label is in a position perpendicular to the rail, with the protuberance securing the label to the rail when the label is in a position parallel to the rail. Upon attaching the label on the rail, the compression of the resilient substance by the lips of the rail prevents the label from slidably moving in a horizontal direction along the rail.

22 Claims, 4 Drawing Sheets

NON-SLIDABLE DISPLAY LABEL

BACKGROUND OF THE INVENTION

The present invention relates to electronic price displaying labels mountable in a display position along a rail.

Experience has shown that physical placement of products within a store can have enormous influence on the sales of the products. Factors such as shelf height for a product and the number of product facings along a shelf can be of great significance to store planners. Thus, it is important for a store planner to ensure that the store plan showing product locations on shelves, is faithfully followed. Oftentimes, however, deviations from the store plan could result from accidental or intentional misplacement of the labels by store personnel, by customers, or by others.

Electronic price displaying labels mountable in a display position along a rail have been known in the prior art. In the prior art, the electronic price displaying label comprises a protuberance connected to the rear portion of the label, a first groove arranged around the bottom of the protuberance, and a second groove arranged horizontally across the top of the label and the top of the protuberance. The top of the label is of a smaller width than the bottom of the label and the first groove and second groove are spaced at an unequal distance from the forward portion of the label. A cylindrical slot is provided perpendicular to and within the second groove and positioned horizontally from the protuberance. A locking pin mechanism is provided on the label having a key slot arranged on the front of the label and a locking pin arranged on the rear of the label and positioned horizontally from the protuberance. The display of the electronic price display label is of a liquid-crystal type.

The rail upon which the above-described electronic price displaying label is mountable consists of two parallel oppositely disposed lips provided on the forward side of the rail such that the lips define a cavity and an accessible slot. The rail back, top, bottom, first lip and second lip are substantially planar, with the first lip and top defining a first corner of the rail and with the second lip and bottom defining a second corner. In addition, the distance from one first corner to the bottom edge of the first lip differs from the distance from the top edge of the second lip to the second corner. The first and second lips are spaced at unequal distances from the back of the rail with the first lip joined to the top of the rail and the second lip joined to the bottom of the rail. The first lip and second lip provided on the rail may be engaged with a first and second groove disposed on the label such that the label can be secured onto the rail.

The aforementioned label can be secured onto the rail by inserting the protuberance of the label into the cavity of the rail when the label is in a position perpendicular to the rail and then rotating the label counterclockwise to a position parallel to the rail such that the label is secured onto the rail. Further, the label can be locked onto the rail using the aforementioned locking mechanism provided on the label by inserting a key into the key slot provided on the front of the label and rotating the key such that the locking pin provided on the rear of the label is activated and engages with the lower lip of the rail to lock the label onto the rail, thus preventing removal of the label without use of the key. A multitude of labels may be attached at a number of possible locations on the rail described above. This arrangement, however, has a drawback in that it can be too easy for the label to slide in a horizontal direction along the rail thus enabling easy misplacement of the label.

Some prior attempts have been made to detect the misplacement of the above-described electronic price displaying labels in an effort to remedy accidental or intentional misplacement. One such prior art attempt involves the use of an individual electronic controller serving each rail. However, such a remedy can, at best, detect misplacement only if a label has strayed so far as to be on a rail served by another controller. Besides requiring a large number of controllers in a given installation and being ineffective to detect misplacement to a different location along a rail served by a given controller, such systems require that individual labels perform many of the communication transactions, requiring more complex and thus costly, electronic components.

Accordingly, it is desirable to have an electronic price displaying label whereby the misplacement of the label secured in a display position along a rail, specifically misplacement of the label in a horizontal direction along the rail, is prevented, thereby ensuring that a store plan showing product locations on shelves is faithfully followed.

SUMMARY OF THE INVENTION

To overcome the problem of accidental or intentional misplacement of the electronic price displaying labels along a rail, the present invention discloses a non-slidable electronic price displaying label comprising a resilient substance and adaptable to be fitted in a display position along a rail having two parallel oppositely disposed lips provided on the forward side of the rail, the lips defining an access slot and a cavity, wherein the label has a protuberance connected to the rear of the label, a first groove arranged around the bottom of the protuberance, and a second groove aligned horizontally across the top of the label. In accordance with the invention, a resilient substance such as a rubber band is provided within one or both of the grooves. A cylindrical slot is provided perpendicular to and within the second groove and positioned horizontally from the protuberance, wherein the cylindrical slot contains a rubber member held in place by an interference fit and having a top portion extending above the bottom surface of the second groove. The rubber member may comprise an o-ring section in accordance with the invention. The label is secured onto the rail by inserting the protuberance of the label into the cavity of the rail when the label is in a position perpendicular to the rail and then rotating the label counterclockwise to a position parallel to the rail such that compression of the resilient substance provided within the grooves and/or the top portion of the rubber member provided within the cylindrical slot by the lips of the rail effectively prevents the label from slidably moving in a horizontal position along the rail.

Thus, the present invention prevents intentional or accidental misplacement of the electronic labelling device, specifically misplacement of the label in a horizontal position along a rail disposed along the edge of a store shelf.

BRIEF DESCRIPTION OF THE DRAWINGS

An exemplary embodiment of the invention will be described with respect to the drawings, of which.

For convenience of reference, like components, elements, and features in the various figures are designated by the same reference numerals or characters.

DESCRIPTION OF THE PREFERRED EMBODIMENT

Figure 1:
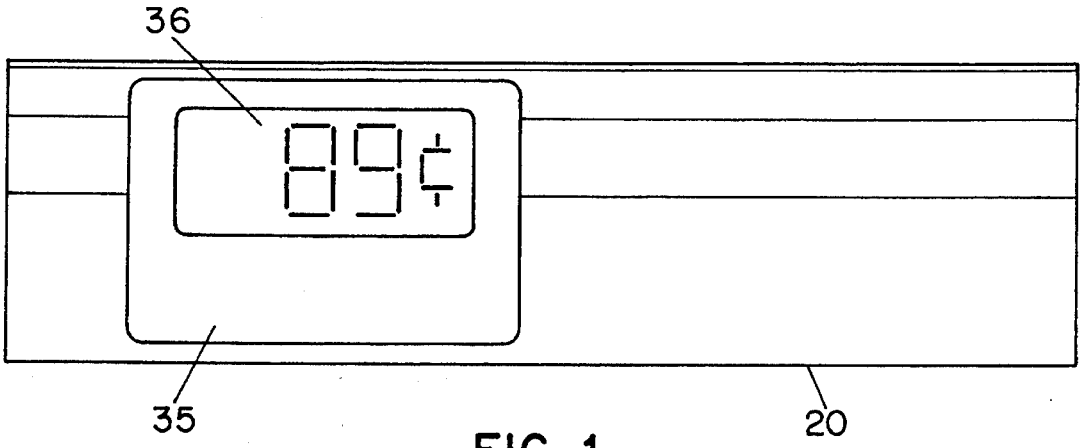
FIG. 1 is a front view of a portion of rail 20 with an electronic label 35 affixed.

FIGS. 1–8 show an embodiment of the present invention. Referring to the drawings, FIG. 1 illustrates the disposition of an electronic price displaying label 35 along a rail 20. A multitude of labels may be attached to the rail as shown at one of the many possible locations on the rail. The labels 35 may be employed in a retail store where goods for sale are placed on shelves to display the prices of the goods placed nearby. The prices 36 to be displayed are communicated to the respective labels from a central computer (not shown).

Figure 2:
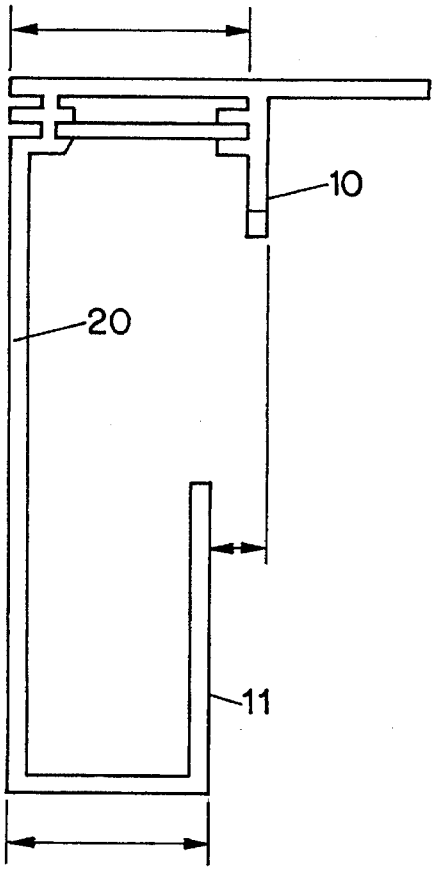
FIG. 2 is a cross section view of the rail 20 of FIG. 1 having a first lip 10 and a second lip 11.

FIG. 2 provides a cross section view of the rail 20 shown in FIG. 1. The cross section of the rail is substantially constant along the entirety of the length of the rail, such that any arbitrary position along the length of rail is a potential location where a label 35 may be installed. As shown in FIG. 2, the first and second parallel oppositely disposed lips, 10 and 11 respectively, provided on the forward side of the rail are spaced at unequal distances from the back of the rail. In accordance with the invention, the rail back, top, bottom, first lip and second lip are substantially planar, with the first lip and top defining a first corner of the rail and with the second lip and bottom defining a second corner. Also, the distance from the first corner to the bottom edge of the first lip differs from the distance from the top edge of the second lip to the second corner. The first lip 10 and second lip 11 provided on the rail may be engaged with a first and second groove disposed on the aforementioned label 35 such that the label can be secured along the rail 20.

Figure 3:
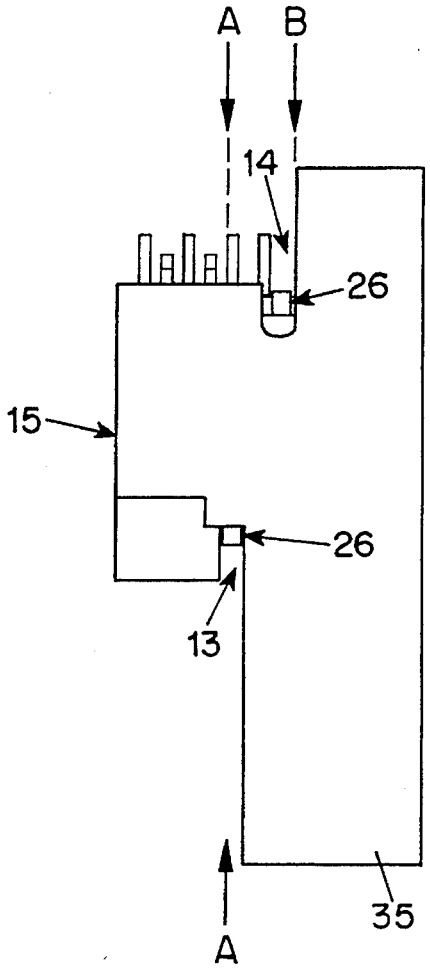
FIG. 3 is a side view of the electronic label 35 showing a protuberance 15, a first groove 13 and a second groove 14 and a resilient substance 26 contained within the first groove 13 and second groove 14, with each groove disposed on the rear of the label for fitting the label in a display position along the rail.
Figure 5:
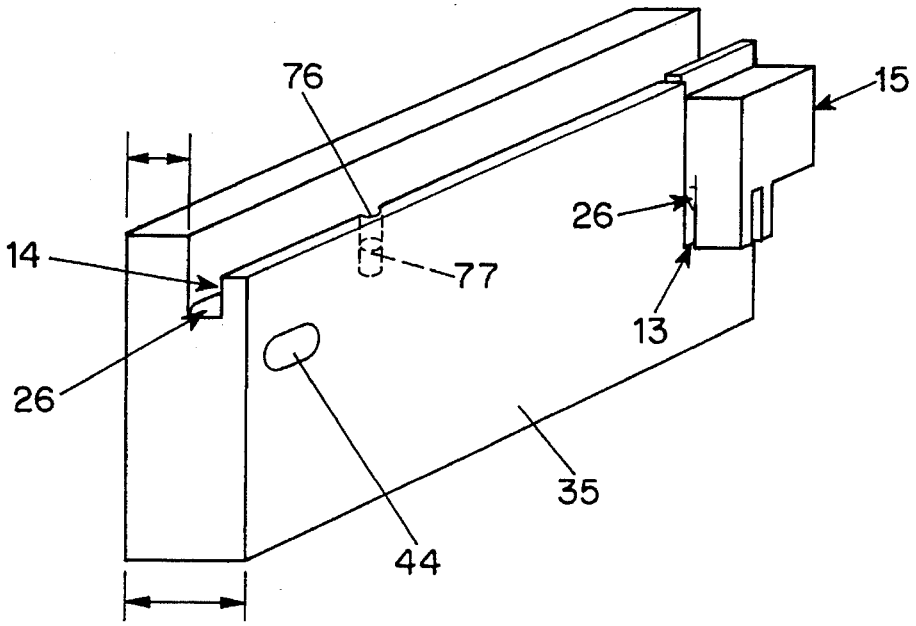
FIG. 5 is a perspective view of the electronic label 35 showing the rear and side of the label with the protuberance 15, the first groove 13, the second groove 14, resilient substance 26 contained within each of the grooves, locking pin 44, cylindrical slot 76 containing rubber member 77 and also illustrating the difference in width between the top and bottom of the label.

FIGS. 3 and 5 provide side and perspective views of an electronic price displaying label 35. As shown in FIG. 3, the label comprises a protuberance 15, a first groove 13 arranged around the bottom of the protuberance and a second groove 14 aligned horizontally across the top of the label and the top of the protuberance. A resilient substance 26, such as a rubber band, is provided within the first groove 13 such that when the label is attached to a rail, the compression of the resilient substance 26 by the first and second lips of the rail effectively prevents the label from slidably moving in a horizontal direction along the rail. As shown in FIG. 3 and FIG. 5, it should be noted that the top of the label has a smaller width than the bottom of the label. In addition, as shown in FIG. 3, the first groove 13 and second groove 14 are spaced at an unequal distance from the front of the label, as indicated by sections A and B, such that the label can be removably secured along the rail 20 in a effective and efficient manner. Additionally, as shown in FIG. 5, locking pin 44 is provided on the rear of the label. All of the labels are structurally identical to one another with the front of each label comprising a display, for example, of liquid crystal type. Also, as shown in FIG. 5, phantom lines are used to indicate a cylindrical slot 76 provided perpendicular to and within the second groove and which contains a rubber member 77 held in place by an interference fit and having a top portion extending above the bottom surface of the second groove 14. Compression of the rubber member 77 by the first lip of the rail prevents the label from slidably moving in a horizontal direction along the rail.

Figure 4:
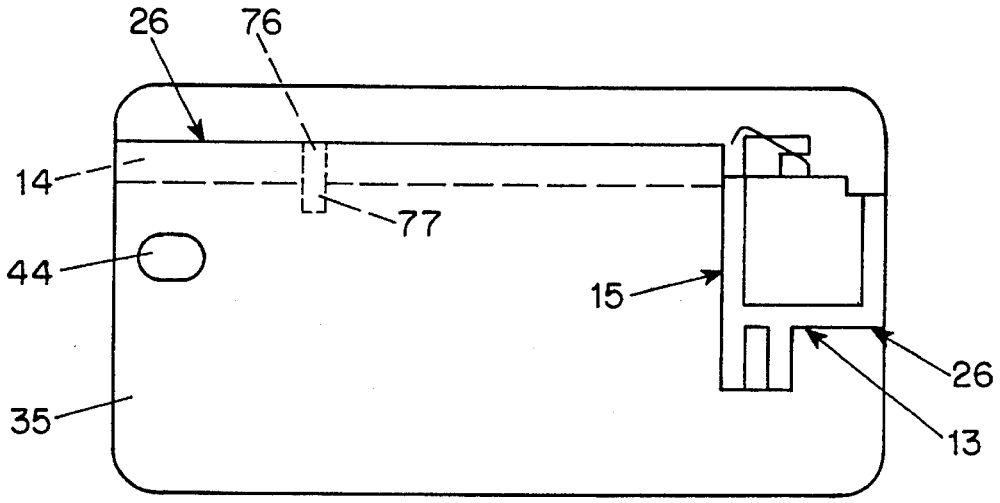
FIG. 4 is a back view of the electronic label 35 showing in greater detail the arrangement of the first groove 13, the second groove 14, the locking pin 44, cylindrical slot 76 containing rubber member 77 and the protuberance 15 disposed on the rear of the label 35.

FIG. 4 illustrates a back view of the label 35 whereby the physical disposition of the protuberance 15, the locking pin 44 and the first and second grooves, 13 and 14 respectively, is shown in more detail. Resilient substance 26 is contained within each of the aforementioned grooves. Phantom lines are used to illustrate cylindrical slot 76 provided perpendicular to and within the second groove. A rubber member 77 is held in place within the aforementioned cylindrical slot 76 by an interference fit, with the top portion of the rubber member extending above the bottom surface of the second groove 14.

Figure 4A:
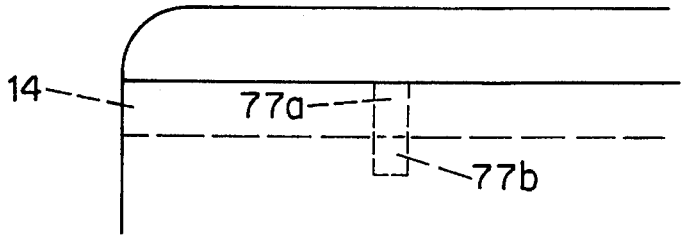
FIG. 4*a* is a more detailed view of the second groove 14 and the rubber member, which is shown divided into a top portion 77*a* and bottom portion 77*b;*

FIG. 4*a* illustrates the rubber member held within cylindrical slot 76 in more detail by dividing the rubber member into a top portion 77*a* and a bottom portion 77*b*. As illustrated in the figure, the bottom portion of the rubber member 77*b* extends below the bottom surface of the second groove 14 and the top portion of the rubber member 77*a* extends above the bottom surface of the second groove 14. Compression of the top portion of the rubber member 77*a* by the first lip of the rail prevents the label from slidably moving in a horizontal direction along the rail.

Figure 6:
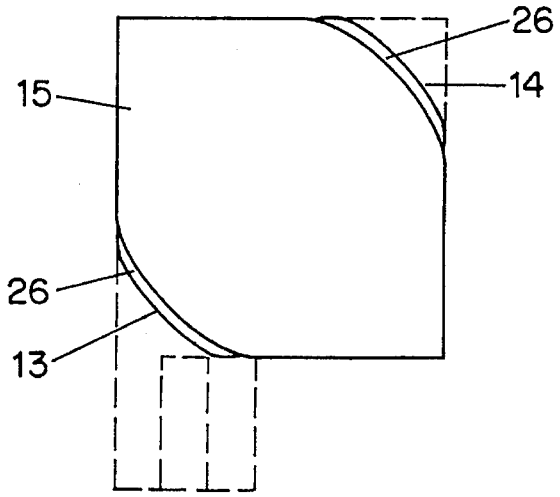
FIG. 6 is a cross section view of the protuberance 15 as referenced in FIG. 3 by sections A and B illustrating the arrangement of the first groove 13 and the second groove 14 on the rear of the electronic label 35 such that a base is formed around the protuberance having a constant diameter.

A cross section view of sections A and B of the protuberance 15 as referenced in FIG. 3 is illustrated by FIG. 6. FIG. 6 shows a more detailed view of both the first groove 13, disposed around the bottom of the protuberance, and the second groove 14, aligned at the top of the protuberance. Resilient substance 26 is contained within each of the aforementioned grooves. Phantom lines are used to illustrate the overall structure of the protuberance in relation to the first and second grooves. Furthermore, it should be noted that the alignment of the first and second grooves with respect to the protuberance enables the base of the protuberance to have a constant diameter when the label is being rotated between the position for insertion and the installed position along the rail. These positions are shown in FIGS.

7–7B.

Figure 7:
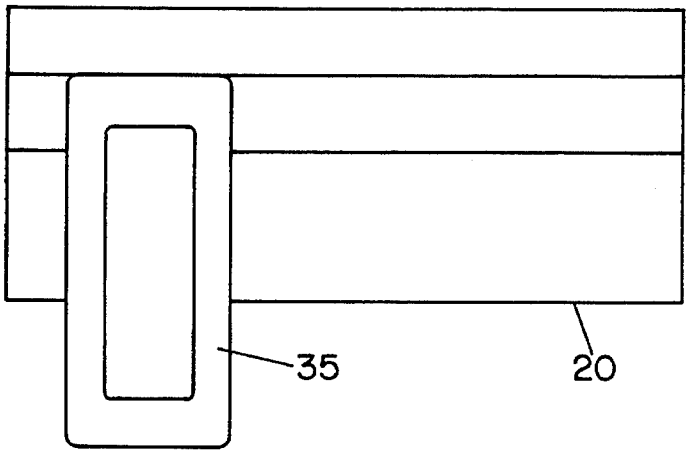
FIGS. 7, 7A, and 7B illustrate how the electronic label 35 is secured along the rail 20, with FIG. 7 showing the position of insertion of the electronic label 35 along the rail 20, and FIGS. 7A–7B showing the electronic label 35 being rotated counterclockwise into the installed position along the rail 20.
Figure 7A:
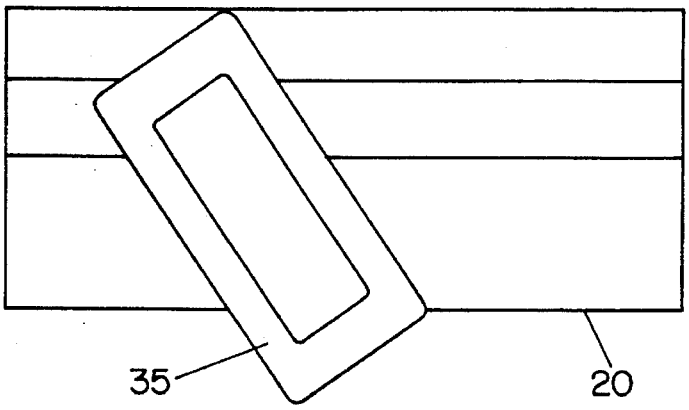
Figure 7B:
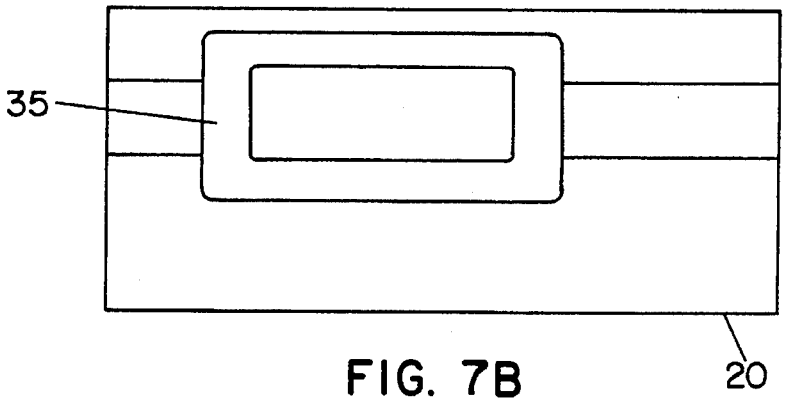

FIG. 7 illustrates the initial insertion of the protuberance of the label 35 onto the rail 20 at a position perpendicular (90°) to the rail. FIG. 7A further depicts the installation process of the label 35 along the rail 20 by showing the counterclockwise rotation of the label to a position 45° from the initial inserted position (FIG. 7) of the label onto the rail. FIG. 7B illustrates the final installed position of the label 35 along the rail 20 wherein the label is at a position horizontal to the rail and wherein resilient substance 26, provided within the grooves, and/or the top portion of the rubber member 77 contained within cylindrical slot 76 has been compressed against the lips of the rail such that the label is prevented from slidably moving along the rail.

Figure 8:
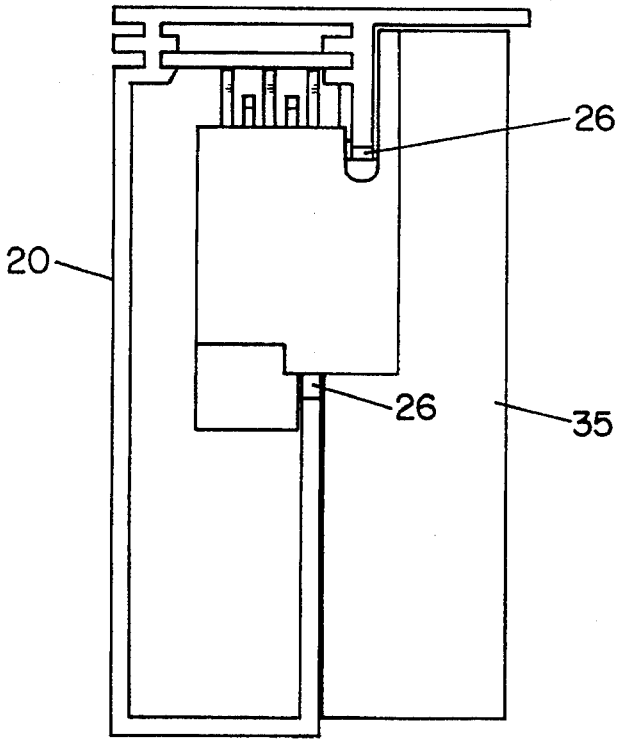
FIG. 8 is a side view of the rail 20 with an electronic label 35 secured along the rail.

FIG. 8 is a superposition of FIG. 2 and FIG. 3 which illustrates a side view of the rail 20 having an electronic label 35 secured along the forward side of the rail. As illustrated in the figure, resilient substance 26 is shown compressed within the grooves of the label by the lips of the rail 20 such that a tight fit is created between the label and the rail. As a result of this particular fit, the label 35 can be prevented from slidably moving in a horizontal direction along the rail 20.

Figure 9:
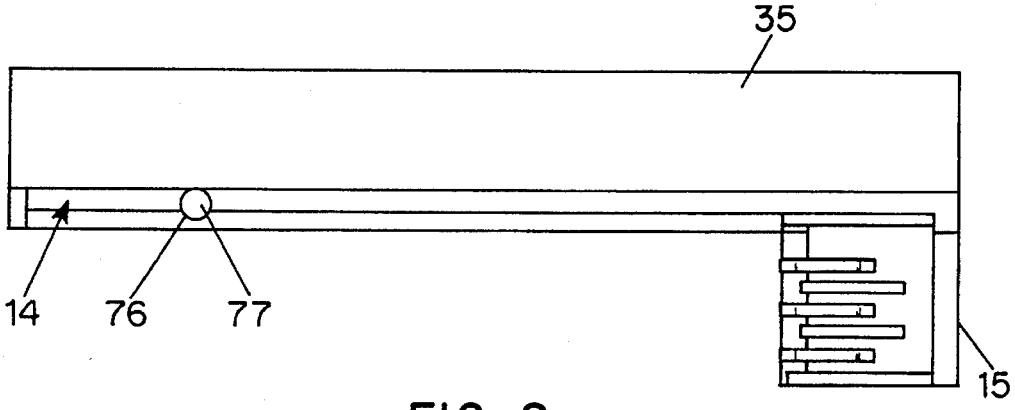
FIG. 9 is a top view of the electronic label 35 illustrating the arrangement of the second groove 14, cylindrical slot 76 containing rubber member 77, and protuberance 15.

A top view of the label 35 is illustrated by FIG. 9. FIG. 9 shows a detailed view of the second groove 14, cylindrical slot 76, and protuberance 15. Rubber member 77 is contained within cylindrical slot 76 and held in place within the aforementioned slot by an interference fit.

As mentioned earlier, in a retail store factors such as shelf height for a product and the number of product facings along a shelf can influence the sales of those particular products. However, accidental or intentional misplacement of the labels by store personnel or customers often occur, including misplacement of the labels along a particular rail. Thus, it is desirable to prevent the misplacement or relocation of the labels along a rail as expeditiously as possible.

In a preferred embodiment, the electronic label 35, as shown in the drawings, comprises a rubber band as resilient substance 26, a portion of which is provided within the first groove 13 and the second groove 14. A cylindrical slot 76 is provided perpendicular to and within the second groove and positioned horizontally from the protuberance wherein the cylindrical slot 76 contains a section of a rubber o-ring 77 held in place by an interference fit and having the top portion of the rubber o-ring extending above the bottom surface of the second groove. The label 35 can be removably secured onto a rail 20 having a first lip 10 and a second lip 11 such that misplacement of the label can be prevented, specifically misplacement of the label in a horizontal direction along a rail. The label 35 is to be secured along the rail 20 by inserting the protuberance of the label through an access slot of the rail in a position perpendicular to the rail, the access slot being defined by the first and second lips 10 and 11 respectively, and then rotating the label counterclockwise to a position parallel to the rail, such that compression of the rubber band and/or the top portion of the rubber o-ring section by the lips of the rail effectively prevents the label from slidably moving in a horizontal direction along the rail. A locking pin mechanism is provided on the label having a movable locking pin 44 provided on the rear of the label 35 and a key slot provided on the front of the label for locking the label onto the rail so as to prevent removal of the label without the use of a special key. To activate the locking pin mechanism, the special key is inserted into the key slot provided on the front of the label and rotated such that the locking pin 44 either engages with the lips of the rail or withdraws from engagement with the lips of the rail.

In an alternate embodiment of the invention, the entirety of the second groove 14 contains a portion of the rubber band, with a portion of the rubber band to be contained within the first groove 13.

Although the invention has been described herein with reference to specific embodiments, many modifications and variations of the invention will readily occur to those skilled in the art. Accordingly, all such variations and modifications are included within the intended scope of the invention.

I claim:

1. A price displaying label system comprising a label and a rail, the label having a front and a rear for removable mounting in a display position along a rail of substantially constant cross-section, the rail comprising a back, a top, and a bottom, and first and second parallel oppositely disposed lips provided on a forward side of the rail, the first lip joined to the rail top and the second lip joined to the rail bottom, the lips defining an access slot with a height, and the back, top, bottom and lips of the rail defining a cavity, the label comprising:

a protuberance having a top and a bottom connected to the rear of the label, the protuberance having a width no greater than the slot height, and having a height greater than the slot height;

a first groove arranged around the bottom of the protuberance disposed for engagement with the second lip;

a second groove aligned horizontally around the top of the protuberance, disposed for engagement with the first lip; and a resilient substance provided within the first and second grooves;

whereby the protuberance of the label may be removed from and inserted into the cavity of the rail when the label is in a position perpendicular to the rail, whereby the protuberance secures the label to the rail when the label is in a position parallel to the rail, and whereby compression of the resilient substance by the lips of the rail prevents the label from slidably moving in a horizontal direction along the rail;

wherein the resilient substance comprises a rubber band around the protuberance, a portion of said band lying within said first groove;

and wherein a cylindrical slot is provided perpendicular to and within the second groove and positioned horizontally from the protuberance wherein the cylindrical slot contains a rubber member held in place by an interference fit and extending above the bottom surface of the second groove.

2. The price displaying label system of claim 1 wherein the rubber member comprises an o-ring section.

3. A price displaying label system comprising a label and a rail, the label having a front and a rear for removable mounting in a display position along a rail of substantially constant cross-section, the rail comprising:

a back, a top, and a bottom, and first and second parallel oppositely disposed lips provided on a forward side of the rail, the first lip joined to the rail top and the second lip joined to the rail bottom, the lips defining an access slot with a height, and the back, top, bottom and lips of the rail defining a cavity within which a label may be inserted at any of a multiplicity of locations along the length of the rail, the label comprising:

a protuberance having a top and a bottom connected to the rear of the label, the protuberance having a width no greater than the slot height, and having a height greater than the slot height;

a first groove arranged around the bottom of the protuberance disposed for engagement with the second lip;

a second groove aligned horizontally around the top of the protuberance, disposed for engagement with the first lip; and a resilient substance provided within the first and second grooves;

whereby the protuberance of the label may be removed from and inserted into the cavity of the rail when the label is in a position perpendicular to the rail, whereby the protuberance secures the label to the rail when the label is in a position parallel to the rail, and whereby compression of the resilient substance by the lips of the rail prevents the label from slidably moving in a horizontal direction along the rail.

4. The price displaying label system of claim 3 wherein the resilient substance comprises a rubber band around the protuberance, a portion of said band lying within said first groove.

5. The price displaying label system of claim 4 wherein the second groove extends across substantially the entirety of the top of the label and wherein the entirety of the second groove contains a portion of the band.

6. The price displaying label system of claim 3 having a cylindrical slot provided perpendicular to and within the second groove and positioned horizontally from the protuberance wherein the cylindrical slot contains a rubber member held in place by an interference fit and extending above the bottom surface of the second groove.

7. The price displaying label system of claim 6 wherein the rubber member comprises an o-ring section.

8. The price displaying label system of claim 3 wherein the lips provided on the forward side of the rail are spaced at an unequal distance from the back of the rail.

9. The price displaying label system of claim 8 wherein the resilient substance comprises a rubber band around the protuberance, a portion of said band lying within said first groove.

10. The price displaying label system of claim 9 wherein the second groove extends across substantially the entirety of the top of the label and wherein the entirety of the second groove contains a portion of the band.

11. The price displaying label system of claim 3 wherein:

(a) the rail back, top, bottom, first lip and second lip are each substantially planar;

(b) the first and second lips are parallel;

(c) the first lip and top define a first corner;

(d) the second lip and bottom define a second corner; and (e) the distance from the first corner to the bottom edge of the first lip differs from the distance from the top edge of the second lip to the second corner.

12. The price displaying label system of claim 11 wherein the lips provided on the forward side of the rail are spaced at an unequal distance from the back of the rail.

13. The price displaying label system of claim 11 wherein the resilient substance comprises a rubber band around the protuberance, a portion of said band lying within said first groove.

14. The price displaying label system of claim 13 wherein the second groove extends across substantially the entirety of the top of the label and wherein the entirety of the second groove contains a portion of the band.

15. The price displaying label system of claim 13 wherein the lips provided on the forward side of the rail are spaced at an unequal distance from the back of the rail.

16. The price displaying label system of claim 15 wherein the second groove extends across substantially the entirety of the top of the label and wherein the entirety of the second groove contains a portion of the band.

17. A price displaying label having a front displaying a price, a rear, a left side, and a right side, the label comprising:

a protuberance connected to the rear of the label and having a top and a bottom, the protuberance having a width less than the height thereof;

a first groove arranged around the bottom of the protuberance;

a second groove aligned horizontally around the top of the protuberance; and a resilient substance provided within the first and second grooves;

said label having a cylindrical slot provided perpendicular to and within the second groove and positioned horizontally from the protuberance wherein the cylindrical slot contains a rubber member held in place by an interference fit and extending above the bottom surface of the second groove.

18. The price displaying label of claim 17 wherein the rubber member comprises an o-ring section.

19. A price displaying label having a front displaying a price, a rear, a left side, and a right side, the label comprising:

a protuberance connected to the rear of the label and having a top and a bottom, the protuberance having a width less than the height thereof;

a first groove arranged around the bottom of the protuberance;

a second groove aligned horizontally around the top of the protuberance; and a resilient substance provided within the first and second grooves;

wherein the first and second grooves are spaced at an unequal distance from the front of the label.

20. The price displaying label of claim 19 wherein the resilient substance comprises a rubber band around the protuberance, a portion of said band lying within said first groove.

21. The price displaying label of claim 20 wherein the second groove extends across substantially the entirety of the top of the label and wherein the entirety of the second groove contains a portion of the band.

22. A price displaying label having a front displaying a price, a rear, a left side, and a right side, the label comprising:

a protuberance connected to the rear of the label and having a top and a bottom, the protuberance having a width less than the height thereof;

a first groove arranged around the bottom of the protuberance;

a second groove aligned horizontally around the top of the protuberance; and a resilient substance provided within the first and second grooves;

wherein the resilient substance comprises a rubber band around the protuberance, a portion of said band lying within said first groove, and wherein the second groove extends across substantially the entirety of the top of the label and wherein the entirety of the second groove contains a portion of the band.

* * * * *